US006375415B1

(12) United States Patent
Burdgick

(10) Patent No.: US 6,375,415 B1
(45) Date of Patent: Apr. 23, 2002

(54) HOOK SUPPORT FOR A CLOSED CIRCUIT FLUID COOLED GAS TURBINE NOZZLE STAGE SEGMENT

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/557,541

(22) Filed: Apr. 25, 2000

(51) Int. Cl.[7] ..... F01D 9/06

(52) U.S. Cl. ..... 415/115; 415/114; 415/116; 415/189; 415/209.2

(58) Field of Search ..... 415/114, 115, 415/116, 189, 190, 209.2, 209.3, 209.4

(56) References Cited

U.S. PATENT DOCUMENTS

| | | | | | |
|---|---|---|---|---|---|
| 3,070,353 | A | * | 12/1962 | Welsh | 415/209.2 |
| 3,807,892 | A | * | 4/1974 | Frei et al. | 415/116 |
| 4,396,349 | A | * | 8/1983 | Hueber | 415/115 |
| 5,634,766 | A | | 6/1997 | Cunha et al. | |
| 6,164,903 | A | * | 12/2000 | Kouris | 415/189 |

FOREIGN PATENT DOCUMENTS

| | | | | | |
|---|---|---|---|---|---|
| AU | 229148 | A | * | 7/1960 | 415/209.2 |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39$^{th}$ GE Turbine State–of–the–Art Technology Seminar", Tab 2, "GE Heavy–Duty Gas Turbine Performance Characteristics", F. J. Brooks, Aug. 1996.

"39$^{th}$ GE Turbine State–of–the–Art Technology Seminar", Tab 3, "9EC 50Hz 170–MW Class Gas Turbine", A. S. Arrao, Aug. 1996.

"39$^{th}$ GE Turbine State–of–the–Art Technology Seminar", Tab 4, MWS6001FA—An Advanced–Technology 70–MW Class 50/60 Hz Gas Turbine, Ramachandran et al., Aug. 1996.

"39$^{th}$ GE Turbine State–of–the–Art Technology Seminar", Tab 5, "Turbomachinery Technology Advances at Nuovo Pignone", Benvenuti et al., Aug. 1996.

"39$^{th}$ GE Turbine State–of–the–Art Technology Seminar", Tab 6, "GE Aeroderivative Gas Turbines—Design and Operating Features", M.W. Horner, Aug. 1996.

"39$^{th}$ GE Turbine State–of–the–Art Technology Seminar", Tab 7, "Advance Gas Turbine Materials and Coatings", P.W. Schilke, Aug. 1996.

"39$^{th}$ GE Turbine State–of–the–Art Technology Seminar", Tab 8, "Dry Low $NO_x$ Combustion Systems for GE Heavy –Duty Turbines", L. B. Davis, Aug. 1996.

(List continued on next page.)

*Primary Examiner*—Christopher Verdier
(74) *Attorney, Agent, or Firm*—Nixon & Vanderhye

(57) ABSTRACT

A nozzle stage segment includes inner and outer bands spaced radially one from the other with a nozzle vane therebetween. The outer band includes a wall defining a portion of the hot gas path flow through the turbine and an outer cover defining a chamber with the outer wall. The vane includes a vane extension integrally cast with the nozzle segment and extending into a vane extension on the cover. The cover mounts a forward hook for structurally mounting the nozzle segment to a fixed part of the turbine casing, thereby establishing a structural load path through the hook, the cover extension and the vane extension upon welding the extension to one another and the outer wall and cover to one another. Cavities in the vane open into the chamber to receive a cooling medium and which cavities and chamber form part of a closed circuit cooling path through the nozzle stage segment.

17 Claims, 4 Drawing Sheets

OTHER PUBLICATIONS

"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines," J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density# Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et a al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176–11.
"Exhibit panels used at 1995 product introduction at PowerGen Europe".
"Extensive Testing Program Validates High Efficiency, Reliability of GE's Advanced "H"Gas Turbine Technology", Press Information, Press Release 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycl Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Tecnology Transfer/pp. 1–3.
"General Electric ATS Program Technical Review, Phase 2 Activities", T. Chance et al., pp. 1–4.
"General Electric's DOE/EATS H Gas Turbine Development" Advanced Turbine Systems Annual Review Meeting, Nov. 7–8, 1996, Washington, D.C., Publication Release.
"H Technology Commercialization", 1998 MarCommm Activity Recommendation, Mar., 1998.
"H Tecnology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21$^{st}$ Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, pp. 3–13, Oct., 1995.
"Proceedings of the Advanced Turbine Systems Annual Program Review Meeting", vol. I, "H Gas Turbine Combined Cycle", J. Corman, pp. 14–21, Oct. 1995.
"Proceedings of the Advanced Turbine Systems Annual Program Review Meeting", vol. I, "Overview of Westinghouse's Advanced Turbine Systems Program", Bannister et al., pp. 22–30, Oct., 1995.
"Proceedings of the Advanced Turbine Systems Annual Program Review Meeting", vol. I, "Allison Engine ATS Program Technical Review", D. Mukavetz, pp. 31–42, Oct., 1995.
"Proceedings of the Advanced Turbine Systems Annual Program Review Meeting", vol. I, "Advanced Turbine Systems Program Industrial System Concept Development", S. Gates, pp. 43–63, Oct., 1995.
"Proceedings of the Advanced Turbine Systems Annual Program Review Meeting", vol. I, "Advanced Turbine System Program Phase 2 Cycle Selection", Latcovich, Jr., pp. 64–69, Oct., 1995.
"Proceedings of the Advanced Turbine Systems Annual Program Review Meeting", vol. I, "General Electric ATS Program Technical Review Phase 2 Activities", Chance et al., pp. 70–74, Oct., 1995.
"Proceedings of the Advanced Turbine Systems Annual Program Review Meeting", vol. I, "Technical Review of Westinghous's Advanced Turbine Systems Program", Diakunchak et al., pp. 75–85, Oct., 1995.
"Proceedings of the Advanced Turbine Systems Annual Program Review Meeting", vol. I, "Advanced Combustion Turbines and Cycles: An EPRI Perspective", Touchton et al., pp. 87–88, Oct., 1995.
"Proceedings of the Advanced Turbine Systems Annual Program Review Meeting", vol. I, "Advanced Turbine Systems Annual Program Review", William E. Koop, pp. 89–92, Oct., 1995.
"Proceedings of the Advanced Turbine Systems Annual Program Review Meeting", vol. I, "The AGTSR Consortium: An Update", Fant et al., pp. 93–102, Oct., 1995.
"Proceedings of the Advanced Turbine Systems Annual Program Review Meeting", vol. I, "Overview of Allison/AGTSR Interactions", Sy A. Ali, pp. 103–106, Oct., 1995.
"Proceedings of the Advanced Turbine Systems Annual Program Review Meeting", vol. I, "Design Factors for Stable Lean Premix Combustion", Richards et al., pp. 107–113, Oct., 1995.
"Proceedings of the Advanced Turbine Systems Annual Program Review Meeting", vol. I, "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct., 1995.
"Proceedings of the Advanced Turbine Systems Annual Program Review Meeting", vol. I, "Materials/Manufacturing Element of the Advanced Turbine Systems Program", Karnitz et al., pp. 152–160, Oct., 1995.
"Proceedings of the Advanced Turbine Systems Annual Program Review Meeting", vol. I, "Land–Based Turbine Casting Initiative", Mueller et al., pp. 161–170, Oct., 1995.
"Proceedings of the Advanced Turbine Systems Annual Program Review Meeting", vol. I, "Turbine Airfoil Manufacturing Technology", Kortovich, pp. 171–181, Oct., 1995.
"Proceedings of the Advanced Turbine Systems Annual Program Review Meeting", vol. I, "Pratt & Whitney Thermal Barrier Coatings", Bornstein et al., pp. 182–193, Oct., 1995.
"Proceedings of the Advanced Turbine Systems Annual Program Review Meeting", vol. I, "Westinhouse Thermal Barrier Coatings", Goedjen et al., pp. 194–199, Oct., 1995.
"Proceedings of the Advanced Turbine Systems Annual Program Review Meeting", vol. I, "High Performance Steam Development", Duffy et al., pp. 200–220, Oct., 1995.
"Proceedings of the Advanced Turbine Systems Annual Program Review Meeting", vol. II, "Lean Premixed Combustion Stabilized by Radiation Feedback and Heterogeneous Catalysis", Dibble et al., pp. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_X$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II,", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Expermiental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluroescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct. 1995.

"Proceedings of the Advanced Turbine Systems Annual Program Review Meeting", vol. II, "Premixed Burner Experiments: Geometry, Mixing, and Flame Structure Issues"Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $No_X$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esloeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_X$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems,", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoto, pp. 233–252.

"Proceedings of the Advanced Turbine Systems Annual Program Review Meeting", "Active Control of Combustion Instabilities in Low $NO_X$ Turbines", Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Mutistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535–552, Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.

"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emisssions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/311766—5628.
"Utility Advanced Turbine System (ATS) Technology Readiness Testing—Phase 3", Document #666274, Oct. 1, 1996–Sep. 30, 1997, Publication Date, Dec. 31, 1997, Report Numbers: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176—5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1995, Report Numbers: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Numbers: DOE/MC/31176—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Numbers: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Numbers: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine System (ATS) Technology Readiness Testing", Phase 3R, Annual Technical Progress Report, Reporting Period: Oct. 1, 1997–Sep. 30, 1998.
"Utility Advanced Turbine System (ATS) Technology Readiness Testing", Document #750405, Oct. 1–Dec. 30, 1998, Publication Date: May, 1, 1999, Report Numbers: DE–FC21–95MC31176–20.
"Utility Advanced Turbine System (ATS) Technology Readiness Testing"Document #1348, Apr. 1–Jun. 29, 1998, Publication Date Oct. 29, 1998, Report Numbers DE–FC21–95MC31176—18.
"Utility Advanced Turbine System (ATS) Technology Readiness Testing—Phase 3", Annual Technical Progress Report, Reporting Period: Oct. 1, 1996–Sep. 30, 1997.
"Utility Advanced Turbine System (ATS) Technology Readiness Testing and Pre–Commercial Demonstration", Quarterly Report, Jan. 1–Mar. 31, 1997, Document #666275, Report Numbers: DOE/MC/31176–07.
"Proceedings of the 1997 Advanced Turbine Systems", Annual Program Review Meeting, Oct. 28–29, 1997.

* cited by examiner

HOOK SUPPORT FOR A CLOSED CIRCUIT FLUID COOLED GAS TURBINE NOZZLE STAGE SEGMENT

BACKGROUND OF THE INVENTION

The present invention relates to supports for gas turbine nozzle stages having closed circuit cooling, for example, steam cooling, and particularly relates to a hook for supporting a closed circuit, steam cooled nozzle stage segment from a fixed portion of the turbine casing.

Closed circuit steam cooled nozzle stages for a gas turbine typically have an annular array of nozzle vane segments each having inner and outer bands with one or more nozzle vanes extending generally radially between the bands. To provide a closed circuit cooling system, each of the bands has a chamber for containing the cooling medium, e.g., steam for cooling the walls of the nozzle stage. The vane between the chambers is divided into cavities and the cooling steam flows from the outer chamber through the cavities for cooling the vane and into the chamber of the inner band for cooling the inner wall. The spent cooling steam then flows through the inner band chamber generally radially outwardly through one or more cavities of the vane to a cooling steam exhaust.

More particularly, as illustrated in U.S. Pat. No. 5,634,766, of common assignee herewith and for each nozzle segment, the outer band comprises an outer wall and a radially outward cover defining the outer chamber between the wall and cover. The cooling steam is supplied through an inlet in the cover and through an impingement plate in the chamber for impingement cooling of the outer wall. The cooling steam then flows through apertures in a cast extension of the vane extending through the outer chamber. From the apertures, steam is directed into inserts in one or more flow cavities in the vane for transmitting the steam through apertures in the inserts for impingement cooling the vane walls, particularly the leading edge. The inner band comprises the inner wall and a radially inner cover and receives the spent cooling steam from the vane. The spent cooling steam reverses direction and flows through apertures in an impingement plate in the inner chamber for impingement cooling of the inner wall. The spent cooling steam flows radially outwardly through an insert in another cavity in the vane for impingement cooling and then through the vane extension of the outer band to a steam exhaust outlet.

From the foregoing, it will be appreciated that the closed loop cooling circuit requires a cover and a wall for each of the outer and inner bands to contain the cooling steam. The nozzle stage segments are also hung from the outer fixed casing of the turbine by forward and aft hooks typically formed integrally with the outer wall of the nozzle stage segment. Particularly, the forward hook is cast as an integral extension of the vane extension. However, difficulties in cooling, manufacturing and attaching the nozzle stage segments to the turbine casings occur with that configuration. For example, the vane extension in the outer band has apertures for flowing the cooling medium into the leading edge cavity of the vane. These cooling apertures cause stress because the load support path for the vane and inner band portions of the nozzle stage segment pass through the hot leading edge and fillet. The cooling flow apertures through each vane extension also afford an undesirable pressure loss as the cooling steam flows from the outer band into the vane. Moreover, from a review of U.S. Pat. No. 5,634,766, it will be appreciated that the location of the forward support hook renders insertion of the impingement cooling insert into the leading edge cavity difficult. Further, the integral mounting of the forward hook on the vane complicates the manufacture and assembly of the nozzle stage segment, affording unnecessary complexity and a substantial number of parts necessary to work around the hook that is cast integrally on the nozzle vane extension.

BRIEF SUMMARY OF THE INVENTION

In accordance with a preferred embodiment of the present invention, the mechanical attachment of the nozzle stage segment to the outer fixed casing of the turbine is accomplished by forward and aft hooks on the outer band, with the forward hook being formed integrally with the cover and the aft hook formed integrally with the outer wall. The vane also includes a vane extension between the wall and cover of the outer band to which the cover with the integral hook is secured, e.g., by welding. The vane extension, however, is spaced back from the leading edge of the vane and the leading edge cavity through the vane. In this manner, the load path extends from the hook through the cover to the vane extension whereby stresses on the hot leading edge and fillet are avoided. That is, the load path includes the first rib between opposite side walls and the first and second cavities of the vane for carrying the load of the cantilevered nozzle. The cover and outer wall are secured, preferably by welding, to one another to define the outer chamber forming part of the closed loop cooling circuit. By locating the forward hook on the outer cover, the impingement insert in the first cavity of the vane can be applied directly. Also, the vane extension does not require apertures for flowing cooling steam into the vane cavities which otherwise would stress the load bearing leading edge of the vane. Also, the number and complexity of the parts is significantly reduced. For example, a single impingement plate can be formed and provided in the outer band chamber about the vane extension. Further, the segment casting is greatly simplified.

In a preferred embodiment according to the present invention, there is provided a nozzle stage segment for a gas turbine, comprising inner and outer bands spaced generally radially from one another and a nozzle vane extending between the bands, the nozzle vane having leading and trailing edges, the outer band including a wall for defining a portion of a hot gas flow path through the turbine and an outer cover radially outwardly of the wall defining a chamber with the wall for forming part of a closed loop cooling circuit through the nozzle stage segment, the outer cover having a generally axially forwardly directed hook for structurally attaching the nozzle stage segment to a support on the turbine.

In a further preferred embodiment according to the present invention, there is provided a nozzle stage segment for a gas turbine, comprising inner and outer bands spaced generally radially from one another and a nozzle vane extending between the bands, the nozzle vane having leading and trailing edges, the outer band including a wall, a vane extension extending generally radially outwardly of the wall, and an outer cover radially outwardly of the wall, the outer cover having a generally axially forwardly directed hook for attaching the nozzle stage segment to a support on the turbine, the vane extension and the outer cover being secured to one another to define a structural load bearing path through the outer cover between the hook and the vane.

DETAILED DESCRIPTION OF THE INVENTION

Figure 1:
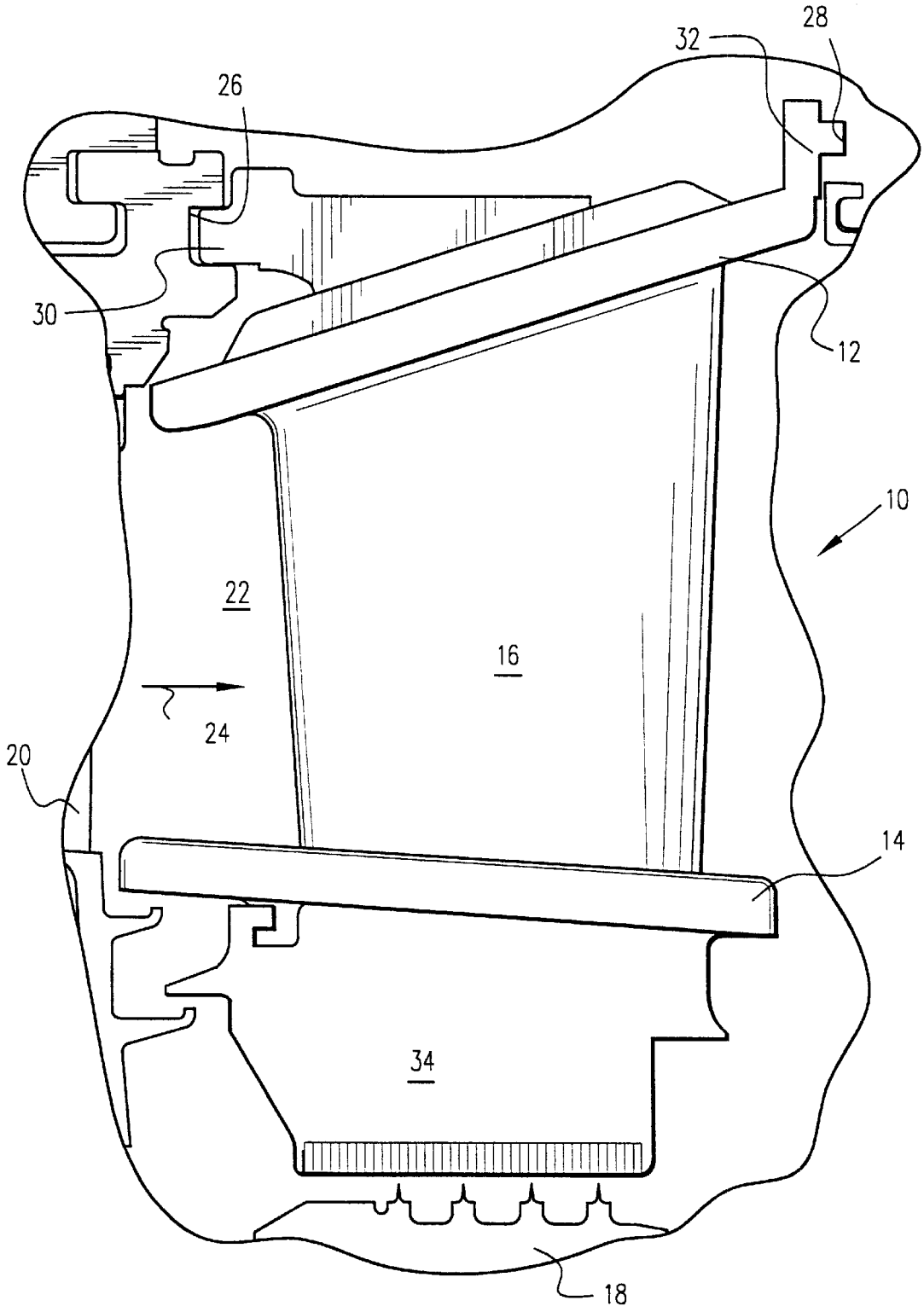
FIG. 1 is a fragmentary side elevational view of a nozzle stage segment constructed in accordance with the present invention.

Referring now to FIG. 1, there is illustrated a nozzle stage segment, generally designated 10, comprised of an outer band 12, an inner band 14 and a nozzle vane 16 extending generally radially between the outer band 12 and inner band 14. It will be appreciated that the nozzle stage segment illustrated in FIG. 1 is one of an annular array of segments arranged about a rotor axis and about a rotor, portions of which are illustrated at 18. As conventional, the rotor includes a plurality of buckets, one being partially illustrated at 20, for rotation about the turbine axis, the buckets 20 and vanes 16 lying in a hot gas path 22. The direction of flow of the hot gas is indicated by the arrow 24.

The nozzle stage segments 10 are secured to a fixed casing of the turbine surrounding the nozzle stages and buckets. Particularly, the fixed casing includes forward and aft recesses or grooves 26 and 28, respectively, for receiving forward and aft hooks 30 and 32 by which each nozzle segment is supported from the fixed casing. The forward and aft hooks form part of the outer band and it will be appreciated that the vane 16, inner band 14 and diaphragm 34 are cantilevered from the forward and aft hooks of the fixed casing.

Figure 2:
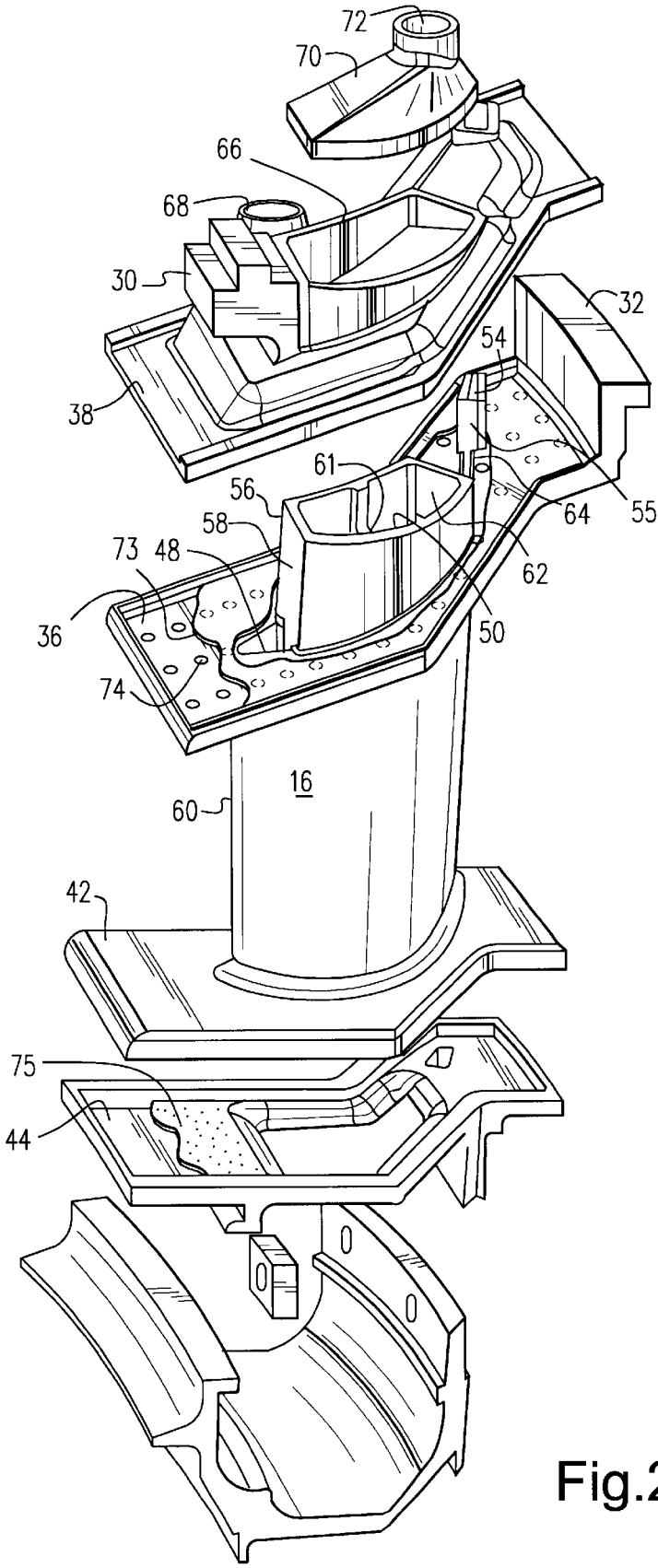
FIG. 2 is an exploded perspective view of various elements forming the nozzle stage segment illustrated in FIG. 1.
Figure 3:
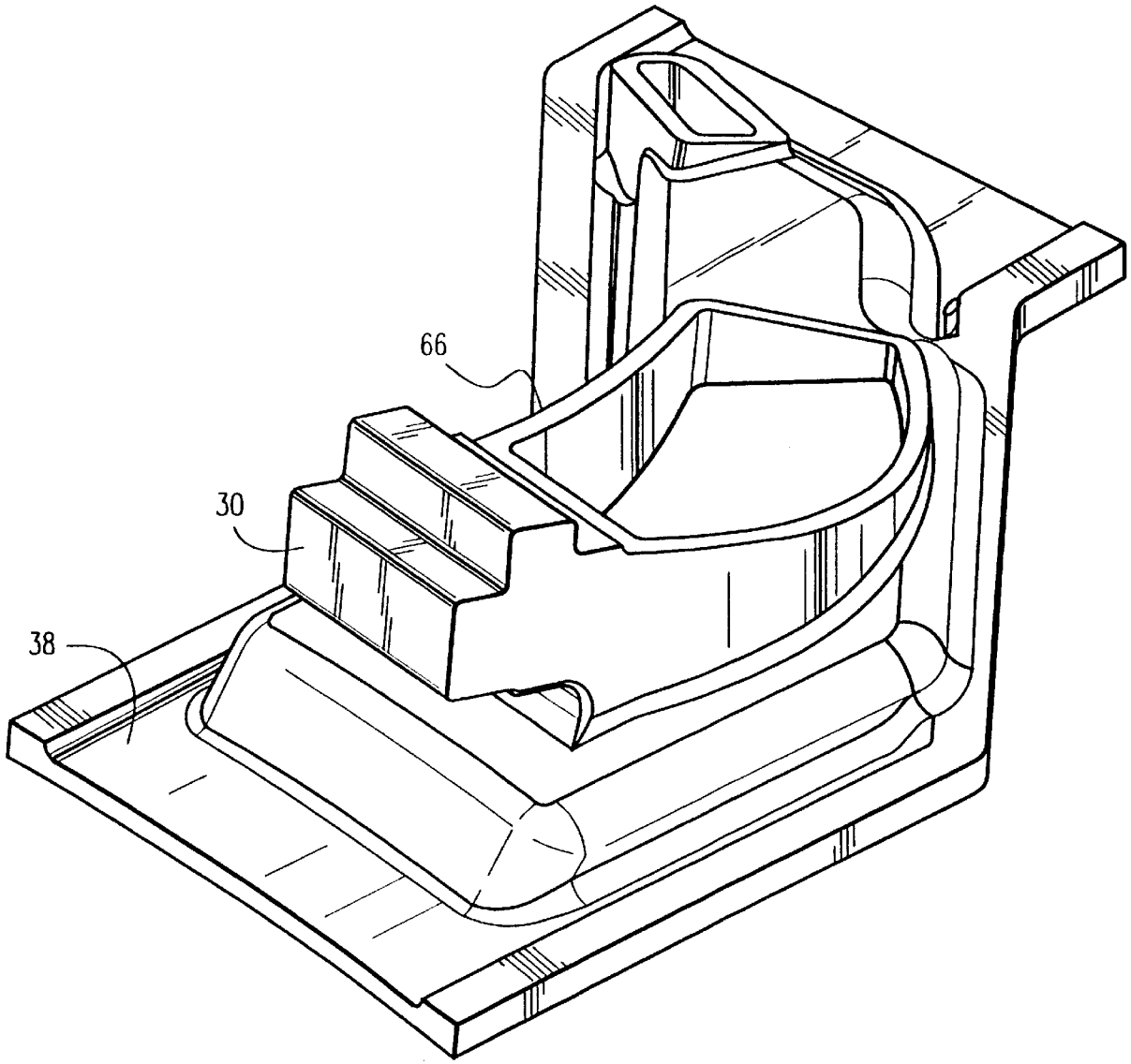
FIG. 3 is a perspective view of an outer cover for the outer band of the nozzle stage segment.

Referring now to FIG. 2, the outer band 12 comprises an outer wall 36 and an outer cover 38 defining in assembly a chamber therebetween. The inner band 14 is formed of an inner wall 42 and an inner cover 44 defining a chamber therebetween. From a review of FIG. 2, it will be appreciated that the vane 16 and outer and inner walls 36 and 42, respectively, comprise an integral casting. Additionally, the vane 16 is divided into a plurality of cavities, including a leading edge cavity 48, intermediate cavities 50, one or more aft cavities 64 and a trailing edge cavity 54. The cavities are separated one from the other by radially extending ribs extending between opposite side walls of the vane 16. A vane extension 56 is also illustrated in FIG. 2 and is defined by the first rib 58 extending through the vane from the leading edge 60 thereof. The vane extension 56 includes opposite side walls contoured in the shape of the vane 16 and having an intermediate rib 61 and aft rib 62. The aft cavities 64 open to the chamber between the outer wall 36 and cover 38. The trailing edge cavity 54 extends along the trailing edge of the vane 16 and forms a separate vane extension 55 in the region of the chamber between wall 36 and cover 38.

The outer cover 38 is preferably comprised of an integral casting including the forward hook 30 and an extension 66 having a corresponding shape as vane extension 56 to receive the upper end of vane extension 56. Cover 38 also includes a cooling medium inlet, for example, steam inlet 68 and a separate steam exit cover 70 having a steam exit 72. The steam exit cover 70, in final assembly, overlies the extension 66. An impingement plate 73 lies in the chamber between the wall 36 and cover 38 and is of a single unitary one-piece construction having a central opening for surrounding the extension 56. Standoffs or pins 74 are provided to support the impingement plate 73 in spaced relation to the wall 36, it being appreciated that the impingement plate has a plurality of apertures or openings therethrough for flowing steam from between the cover 38 and the impingement through the apertures for impingement cooling wall 36.

The cavities through the vane 16 with the exception of the trailing edge cavity open into the chamber between the inner wall 42 and inner cover 44, respectively. The leading edge and aft cavities 48 and 64 conduct the cooling steam through the vane and inserts in the vane, not shown, for impingement cooling of the side walls of the vane 16. The steam flows from the cavities through steam guides, not shown, into the inner chamber on the radially inner side of the impingement plate 75. The steam then flows through the apertures of the impingement plate 75 for impingement cooling of the inner wall 42 and is returned through the vane via the intermediate steam return cavities 50 which empty the steam from the vane through the steam outlet 72.

Figure 4:
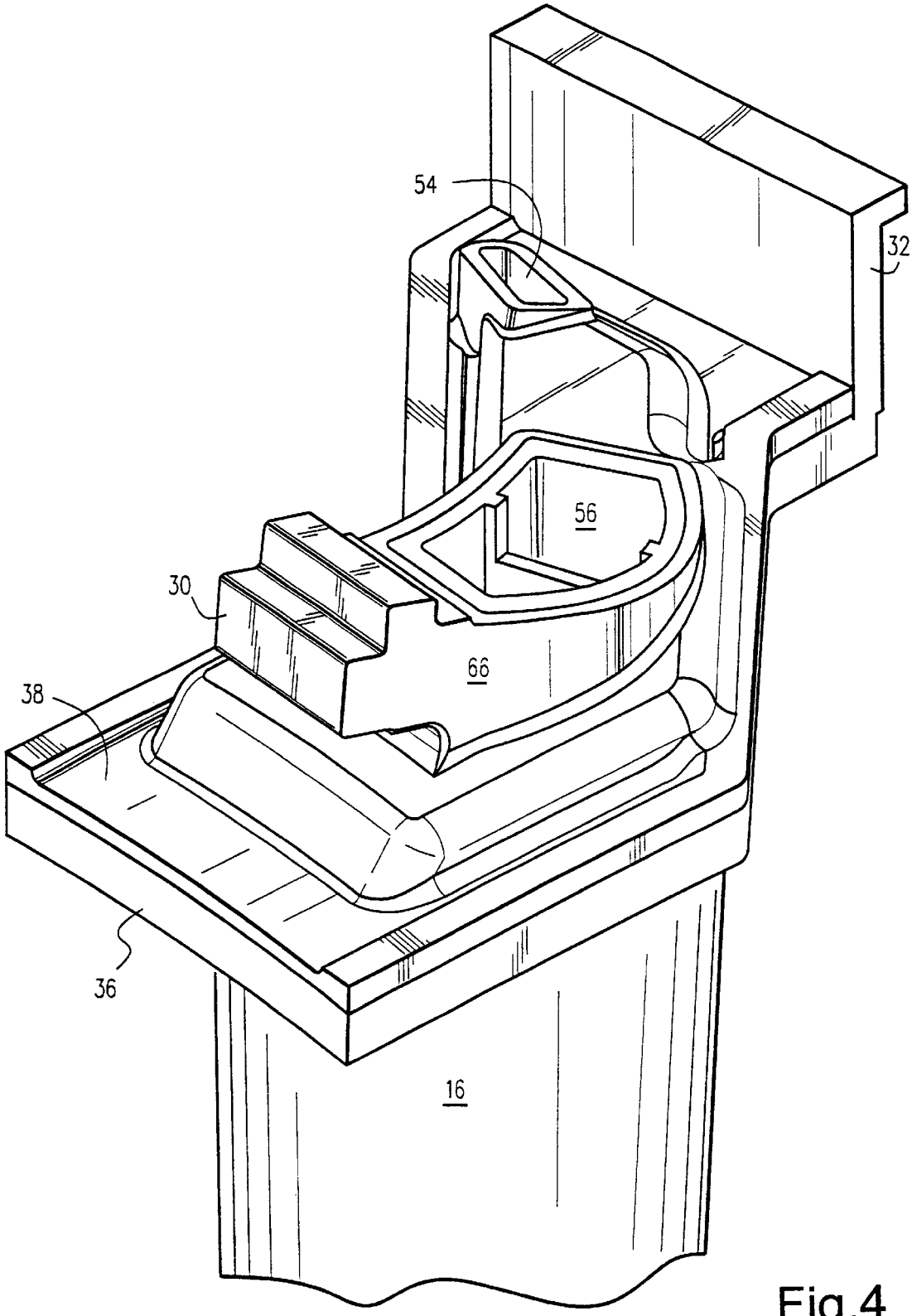
FIG. 4 is a perspective view illustrating the cover secured to the segment.

It will be appreciated that in accordance in the present invention, the forward hook 30 forms an integral part of the cover casting, while the aft hook 32 forms an integral part of the nozzle stage segment casting and particularly of the outer wall 36. As illustrated in FIG. 4, the vane extension 56 is received within the opening of the extension 66. Preferably, the cover is welded to the wall 36 about the adjoining margins along the forward and aft edges, as well as along the lateral slash faces. Additionally, and importantly, the side walls of the vane extension 56 are welded, for example, by E-beam welding, to the wall surfaces of the extensions 66. By welding the extensions to one another, it will be appreciated that the load bearing path from the forward hook 30 extends through the welded extensions directly to the first rib 58 of the vane 16. Moreover, by forming the forward hook 30 on the cover 38 rather than on the integrally cast vane segment as in the prior U.S. Pat. No. 5,634,766, the load bearing path is not interrupted by apertures necessary to provide a path for the cooling medium for flow into the vane. As illustrated in FIG. 2, the cooling steam passes through the openings of the impingement plate 73 for impingement cooling of the outer wall 36 and then flows through the cavities 48 and 64 for flow generally radially inwardly through the vane 16. The need for apertures in the vane extension which would otherwise interrupt the load bearing path is entirely eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle stage segment for a gas turbine, comprising:

inner and outer bands spaced generally radially from one another and a nozzle vane extending between said bands, said nozzle vane having leading and trailing edges, said inner band and said nozzle vane being cantilevered radially inwardly from said outer band;

said outer band including a wall for defining a portion of a hot gas flow path through the turbine and an outer cover radially outwardly of said wall defining a chamber with said wall for forming part of a closed loop cooling circuit through said nozzle stage segment, said cover having an inlet for flowing a cooling medium into said chamber;

said outer cover having a generally axially forwardly directed hook for structurally attaching the nozzle stage segment to a support on the turbine.

2. A nozzle stage segment according to claim 1 wherein said inner band includes an inner wall for defining another portion of the gas flow path through the turbine and an inner cover radially inwardly of said inner wall for defining an inner chamber with said inner wall, said vane having opposite side walls spaced from one another defining at least one cavity therethrough in communication with said outer chamber for supplying a cooling medium from said outer chamber through said one cavity to said inner chamber and a second cavity therethrough in communication with said inner chamber for returning the cooling medium through said vane to a cooling medium outlet port in said outer cover.

3. A nozzle stage segment according to claim 1 including an axially aft directed hook carried by said outer wall for attaching the nozzle stage segment to another support on the turbine.

4. A nozzle stage segment according to claim 1 wherein said outer cover and said outer wall are welded to one another, said hook being integrally cast with said outer cover.

5. A nozzle stage segment according to claim 1 wherein said vane has a vane extension between said outer cover and said wall, said outer cover and said vane extension being welded to one another.

6. A nozzle stage segment according to claim 5 wherein said outer cover has an opening for receiving said vane extension, margins of said outer cover opening and said vane extension being welded to one another.

7. A nozzle stage segment for a gas turbine, comprising:

inner and outer bands spaced generally radially from one another and a nozzle vane extending between said bands, said nozzle vane having leading and trailing edges;

said outer band including a wall, a vane extension extending generally radially outwardly of said wall, and an outer cover radially outwardly of said wall defining a chamber with said wall, said cover having an inlet for flowing a cooling medium into said chamber;

said outer cover having a generally axially forwardly directed hook for attaching the nozzle stage segment to a support on the turbine, said vane extension and said outer cover being secured to one another to define a structural load bearing path through said outer cover between said hook and said vane.

8. A nozzle stage segment according to claim 7 wherein said vane extension and said cover are welded to one another.

9. A nozzle stage segment according to claim 7 wherein said outer cover has an opening for receiving said vane extension, said outer cover and said vane extension being welded to one another about said opening.

10. A nozzle stage segment for a gas turbine, comprising:

inner and outer bands spaced generally radially from one another and a nozzle vane extending between said bands, said nozzle vane having leading and trailing edges;

said outer band including a wall for defining a portion of a hot gas flow path through the turbine and an outer cover radially outwardly of said wall defining a chamber with said wall for forming part of a closed loop cooling circuit through said nozzle stage segment;

said outer cover having a generally axially forwardly directed hook for structurally attaching the nozzle stage segment to a support on the turbine;

said vane having spaced opposite side walls and a plurality of ribs defining a plurality of discrete, generally radially extending cavities, one of said cavities extending between said side walls along the leading edge of said vane and forwardly of a first rib of said plurality of ribs thereof to define a leading edge cavity, said vane having a vane extension between said outer wall and said cover opening through said outer cover, said leading edge cavity opening into said chamber through said outer wall forwardly of said vane extension.

11. A nozzle stage segment according to claim 10 wherein said side walls adjacent the trailing edge of said vane and aft of an aft rib of said plurality of ribs define a trailing edge cavity of said plurality of said cavities, a second vane extension between said outer wall and said cover opening through said cover and defining a continuation of said trailing edge cavity, and at least another of said cavities opening through said outer wall into said chamber between the vane extensions.

12. A nozzle stage segment for a gas turbine, comprising:

inner and outer bands spaced generally radially from one another and a nozzle vane extending between said bands, said nozzle vane having leading and trailing edges;

said outer band including a wall for defining a portion of a hot gas flow path through the turbine and an outer cover radially outwardly of said wall defining a chamber with said wall for forming part of a closed loop cooling circuit through said nozzle stage segment;

said outer cover having a generally axially forwardly directed hook for structurally attaching the nozzle stage segment to a support on the turbine;

said vane including a vane extension between said outer wall and said outer cover, said vane extension being welded to said outer cover, said vane having a load-bearing rib extending between opposite side walls thereof and spaced from the leading edge of said vane and in part defining a load-bearing path through said outer cover and said hook for supporting said vane and said inner band from the turbine support.

13. A nozzle stage segment according to claim 12 wherein said vane has spaced opposite side walls and a plurality of ribs defining a plurality of discrete, generally radially extending cavities, one of said cavities extending between said side walls along the leading edge of said vane and forwardly of said load bearing rib to define a leading edge cavity, said leading edge cavity opening into said chamber through said outer wall forwardly of said vane extension.

14. A nozzle stage segment according to claim 13 wherein said side walls adjacent the trailing edge of said vane and aft of an aft rib of said plurality of ribs define a trailing edge cavity of said plurality of said cavities, a second vane extension between said outer wall and said cover opening through said cover and defining a continuation of said aft cavity, and at least another of said cavities opening through said outer wall into said chamber between the vane extensions.

15. A nozzle stage segment for a gas turbine, comprising:

inner and outer bands spaced generally radially from one another and a nozzle vane extending between said bands, said nozzle vane having leading and trailing edges;

said outer band including a wall for defining a portion of a hot gas flow path through the turbine and an outer cover radially outwardly of said wall defining a chamber with said wall for forming part of a closed loop cooling circuit through said nozzle stage segment;

said outer cover having a generally axially forwardly directed hook for structurally attaching the nozzle stage segment to a support on the turbine; and a one-piece impingement plate between said outer cover and said wall.

16. A nozzle stage segment according to claim 15 wherein said vane includes a vane extension between said outer cover and said wall, said impingement plate having an opening therethrough surrounding said vane extension.

17. A nozzle stage segment for a gas turbine, comprising:

inner and outer bands spaced generally radially from one another and a nozzle vane extending between said bands, said nozzle vane having leading and trailing edges;

said outer band including a wall, a vane extension extending generally radially outwardly of said wall, and an outer cover radially outwardly of said wall;

said outer cover having a generally axially forwardly directed hook for attaching the nozzle stage segment to a support on the turbine, said vane extension and said outer cover being secured to one another to define a structural load bearing path through said outer cover between said hook and said vane;

said vane including a load bearing rib extending between opposite side walls thereof and spaced from a leading edge of said vane, said vane extension having a portion forming an integral extension of said rib and being secured to said cover to define a load bearing path between said hook and said vane.

* * * * *

UNITED STATES PATENT AND TRADEMARK OFFICE

CERTIFICATE OF CORRECTION

PATENT NO. : 6,375,415 B1
DATED : April 23, 2002
INVENTOR(S) : Burdgick

It is certified that error appears in the above-identified patent and that said Letters Patent is hereby corrected as shown below:

Column 6,
Line 67, delete "and" and insert -- including --.

Signed and Sealed this

Eighth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,375,415 B1
APPLICATION NO. : 09/557541
DATED : April 23, 2002
INVENTOR(S) : Burdgick It is certified that error appears in the above-identified patent and that said Letters Patent is hereby corrected as shown below:

Column 1, line 4, below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*